US008790133B2

(12) United States Patent
Myer et al.

(10) Patent No.: US 8,790,133 B2
(45) Date of Patent: Jul. 29, 2014

(54) HEADER CONNECTOR

(71) Applicant: Tyco Electronics Corporation, Berwyn, PA (US)

(72) Inventors: John Mark Myer, Millersville, PA (US); Hurley Chester Moll, Hershey, PA (US); Daniel Williams Fry, Elizabethtown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 15 days.

(21) Appl. No.: 13/633,511

(22) Filed: Oct. 2, 2012

(65) Prior Publication Data

US 2014/0094043 A1 Apr. 3, 2014

(51) Int. Cl.
*H01R 13/66* (2006.01)

(52) U.S. Cl.
USPC ..... 439/567; 439/83

(58) Field of Classification Search
USPC ..... 439/79, 80, 83, 567, 570–572, 607.07, 439/607.09, 607.11
See application file for complete search history.

(56) References Cited

U.S. PATENT DOCUMENTS

| | | | | | |
|---|---|---|---|---|---|
| 5,145,384 | A * | 9/1992 | Asakawa et al. | 439/78 |
| 5,334,049 | A | 8/1994 | Kachlic et al. | |
| 5,575,663 | A * | 11/1996 | Broschard et al. | 439/79 |
| 5,731,958 | A * | 3/1998 | Kozel | 361/743 |
| 5,820,387 | A * | 10/1998 | Borisch et al. | 439/79 |
| 6,565,383 | B1 * | 5/2003 | Wu | 439/567 |
| 6,589,077 | B1 * | 7/2003 | Wu | 439/567 |
| 6,655,990 | B2 * | 12/2003 | Terauchi et al. | 439/567 |
| 6,679,727 | B1 * | 1/2004 | Yu | 439/567 |
| 7,726,983 | B2 * | 6/2010 | Zhu | 439/79 |
| 8,105,109 | B2 * | 1/2012 | Honda | 439/567 |
| 2007/0173134 | A1 | 7/2007 | Takahashi et al. | |

OTHER PUBLICATIONS

International Search Report, International Application No. PCT/US2013/059595, International Filing Date, Sep. 13, 2013.

* cited by examiner

*Primary Examiner* — Thanh Tam Le

(57) ABSTRACT

A header connector includes a housing configured to be mounted to a mounting surface of the circuit board and header contacts held by the housing. The header contacts have mating portions and mounting portions. The mounting portions are configured to be surface mounted to corresponding pads on the circuit board. A spring clip is coupled to the housing. The spring clip has a spring finger extending through the circuit board to engage a bottom side of the circuit board opposite the mounting surface of the circuit board. The spring clip pulls the housing and header contacts toward the mounting surface.

20 Claims, 5 Drawing Sheets

HEADER CONNECTOR

BACKGROUND OF THE INVENTION

The subject matter herein relates generally to surface mount header connectors for mating engagement with plug connectors.

Connector systems typically include plug connectors mated with corresponding receptacle connectors to form a connector assembly. For example, automobile wiring systems typically include such electrical connectors. The plug connector is mated into a shroud of the header connector. The header connector is in turn mounted on a circuit board along a contact interface. At least some known receptacle connectors are right angle receptacle connectors wherein the plug connector is mated in a direction that is parallel to the contact interface between the header connector and the circuit board. Each of the plug assembly and the header assembly typically includes a large number of electrical contacts, and the contacts in the header assembly are electrically and mechanically connected to respective contacts in the plug assembly when the header assembly and the plug assembly are engaged.

Surface mount header connectors provide a number of advantages over through-hole mounted header connectors. In addition to offering cost and process advantages, surface mounting allows for a reduced footprint for the header connector and thus saves valuable space on a circuit board or permits a reduction in size of the circuit board. When the header connector is surface mounted to a circuit board, solder tails extend from one side of the header connector in an angled manner for surface mounting to a circuit board. The large number of contacts presents manufacturing and assembly challenges in fabricating the header connector, as well as installation problems during surface mounting of the header connector to the circuit board.

For example, it is desirable for surface mounting that the solder tails of the header connector are coplanar to one another for mounting to the plane of a circuit board. Achieving coplanarity with a large number of contacts, however, is difficult due to manufacturing tolerances over a large number of contacts. Sometimes additional solder paste is utilized to compensate for tolerances of the contacts or for misalignment of the contacts during assembly of the header connector. The use of additional solder paste, particularly on systems having tight pitches between contacts is problematic as seepage can cause bridging or electrical shorting. Additionally, over a large number of header connectors, the incremental cost of the increased amount of solder paste per header connector can be significant, and non-planarity of the contacts with respect to the plane of the circuit board may negatively affect the reliability of the header connector. Depending upon the degree of non-planarity of the solder tails, some of the contacts may be weakly connected or not connected to the circuit board at all, either of which is an undesirable and unacceptable result.

A need remains for a header connector that may be mounted to a circuit board in a reliable manner with the contacts achieving coplanarity.

BRIEF DESCRIPTION OF THE INVENTION

In one embodiment, a header connector is provided including a housing configured to be mounted to a mounting surface of the circuit board and header contacts held by the housing. The header contacts have mating portions and mounting portions. The mounting portions are configured to be surface mounted to corresponding pads on the circuit board. A spring clip is coupled to the housing. The spring clip has a spring finger extending through the circuit board to engage a bottom side of the circuit board opposite the mounting surface of the circuit board. The spring clip pulls the housing and header contacts toward the mounting surface.

Optionally, the spring finger may impart a downward force on the housing to pull the housing and header contacts towards the mounting surface. The spring clip may include a ramp portion that is upward facing. The ramp portion is configured to engage the bottom side of the circuit board to pull the housing downward. The spring finger may be deflected toward the housing to align with an opening in the circuit board to load the spring finger through the circuit board, wherein upon releasing the spring finger the ramp portion is driven against the bottom side of the circuit board at the opening to drive the spring finger in a downward direction to pull the housing towards the mounting surface.

Optionally, the spring finger may be deflectable towards the housing and may spring away from the housing when released in a releasing direction generally parallel to the mounting surface. The ramp portion may be angled at approximately 45° with respect to the bottom side of the circuit board. The ramp portion may engage the bottom side of the circuit board to convert spring force of the spring finger along the releasing direction to a pulling force in a direction generally perpendicular to the spring force.

Optionally, the header connector may include an alignment pin extending from the housing that is configured to be received in the circuit board to align the housing and header contacts with the circuit board. The alignment pin may restrict movement of the header connector in a mounting direction generally perpendicular to the mounting surface of the circuit board. Spring forces of the spring finger may cause movement of the header connector along the mounting direction toward the mounting surface.

Optionally, the header connector may include surface mounting tabs extending from a bottom of the housing. The surface mounting tabs may be coplanar along a mounting plane and may be configured to engage and be soldered to the circuit board. The mounting portions of the header contacts may be positioned below the mounting plane prior to mounting to the circuit board. The mounting portions of the header contacts may be preloaded against the circuit board when the surface mounting tabs are mounted to the circuit board. The mounting portions of the header contacts may be coplanar with the surface mounting tabs along the mounting plane when the surface mounting tabs are mounted to the circuit board.

Optionally, the housing may include a front and a rear, a top and a bottom. The housing may have a cavity open at the front for receiving a mating connector. The housing may have mounting legs extending from the rear. The mounting legs may have bottoms facing the circuit board. The mounting legs may be configured to be mounted to the mounting surface of the circuit board such that the rear of the housing is forward of the front edge of the circuit board, the top of the housing is positioned higher than the mounting surface of the circuit board and the bottom of the housing is positioned lower than a bottom side of the circuit board. The cavity may be generally vertically aligned with the circuit board forward of the circuit board.

DETAILED DESCRIPTION OF THE INVENTION

Figure 1:
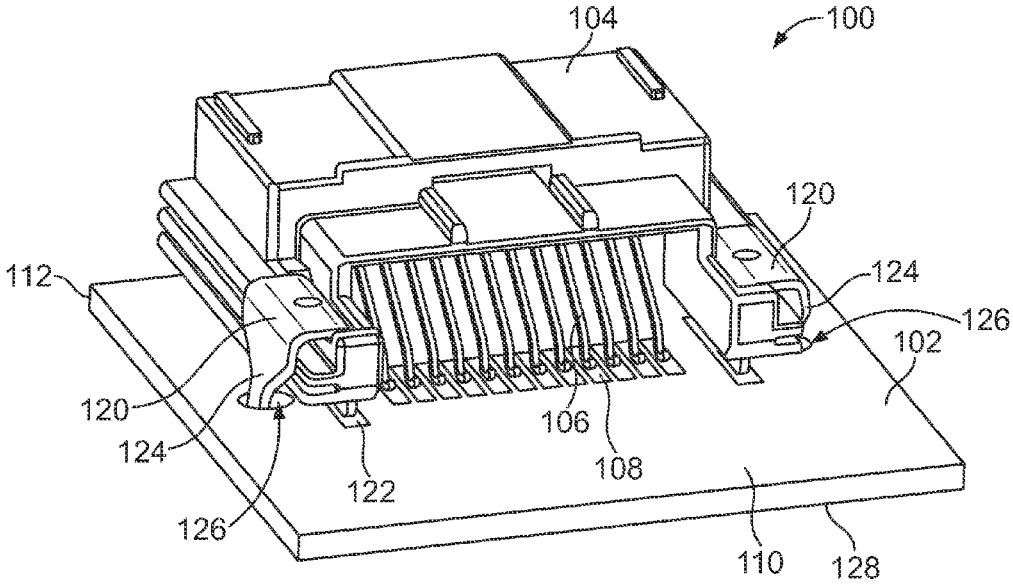
FIG. 1 is a rear perspective view of a header connector formed in accordance with an exemplary embodiment.

FIG. 1 is a rear perspective view of a header connector 100 formed in accordance with an exemplary embodiment. The header connector 100 is mounted to a circuit board 102. The header connector 100 is configured to be mated with a corresponding plug connector (not shown). The header connector 100 receives the plug connector during mating. The header connector 100 may be used as part of an automobile wiring system, in an exemplary embodiment. The header connector 100 may be used in other applications in alternative embodiments.

The header connector 100 includes a housing 104 holding a plurality of header contacts 106 configured to be surface mounted to corresponding pads 108 on a mounting surface 110 of the circuit board 102. During assembly, the header connector 100 is generally mounted to the mounting surface 110 of the circuit board 102 proximate to a front edge 112 thereof. Optionally, a portion of the header connector 100 may overhang the front edge 112.

In an exemplary embodiment, the housing 104 is secured to the circuit board 102 using spring clips 120. The spring clips 120 have portions that are surface mounted to the circuit board 102, such as at corresponding soldered pads 122 on the mounting surface 110 of the circuit board 102. In an exemplary embodiment, the spring clips 120 include spring fingers 124 that extend through openings 126 in the circuit board 102. The spring fingers 124 engage the circuit board 102 to secure the header connector 100 to the circuit board 102. In an exemplary embodiment, the spring fingers 124 engage a bottom side 128 of the circuit board 102 and press against the bottom side 128 to pull the housing 104 and header contacts 106 toward the mounting surface 110. The spring fingers 124 extend entirely through the circuit board 102 to engage the bottom side 128. A spring force of the spring clips 120 urges the housing 104 and header contacts 106 against the mounting surface 110.

The spring clips 120 may be used to initially position and hold the header connector 100 on the circuit board 102 prior to soldering the spring clips 120 to the solder pads 122 and soldering the header contacts 106 to the corresponding pads 108. The soldered connections make a more permanent and stronger mechanical connection between the header connector 100 and the circuit board 102 than the temporary, spring biasing connection made by the spring clips 120 with the circuit board 102.

In an exemplary embodiment, the header contacts 106 are held in a coplanar arrangement for soldering to the pads 108 by the spring clips 120. For example, the spring clips 120 may pull the housing 104 and header contacts 106 against the mounting surface 110, which preloads the header contacts 106 against the pads 108 prior to soldering the header contacts 106 to the pads 108. The spring forces imparted by the spring clips 120 on the header connector 100 may be greater than the preloading force incurred between the header contacts 106 and the circuit board 102. The spring clips 120 hold the header connector 100 in place, with the header contacts 106 preloaded against the pads 108, so that the header contacts 106 may then be soldered to the pads 108.

Figure 2:
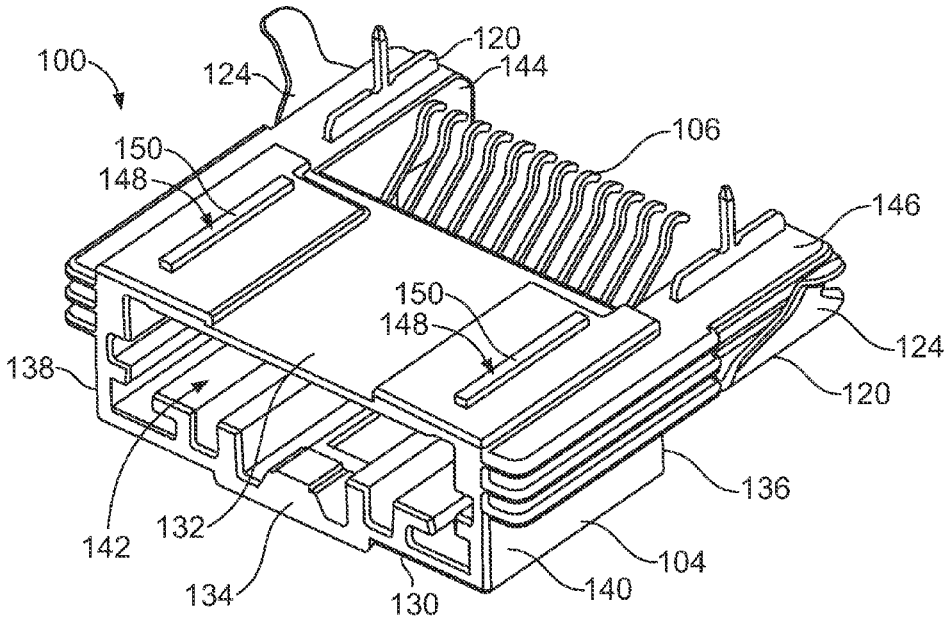
FIG. 2 is a bottom perspective view of the header connector.

FIG. 2 is a bottom perspective view of the header connector 100. The housing 104 is manufactured from an electrically insulative (i.e., non-conductive material), such as plastic, according to a known process, such as an injection molding process. It is recognized, however, that the housing 104 may alternatively be formed of separate pieces and from other materials as those in the art may appreciate.

The housing 104 includes a top 130 and a bottom 132 generally opposite the top 130. The housing 104 includes a front 134 and a rear 136 generally opposite the front 134. The housing 104 includes opposite sides 138, 140 extending between the front 134 and the rear 136. In an exemplary embodiment, the housing 104 is generally boxed shaped, however, the housing 104 may have other shapes and alternative embodiments. The housing 104 includes a cavity 142 that receives the plug connector (not shown) therein. The cavity 142 is open at the front 134 to receive the plug connector.

In the illustrated embodiment, the housing 104 is a right angle housing, wherein the housing 104 receives the plug connector in the cavity 142 in a direction generally parallel to the bottom 132, and thus the circuit board 102 (shown in FIG. 1). In an alternative embodiment, the housing, 104 may be a vertical housing wherein the plug connector may be plugged into the cavity 142 in a direction generally perpendicular to the circuit board 102.

The housing 104 includes mounting legs 144, 146 extending rearward from the rear 136. In the illustrated embodiment, the mounting legs 144, 146 are positioned near the bottom 132. Other positions of the mounting legs 144, 146 are possible alternative embodiments. The mounting legs 144, 146 extend from the housing 104 proximate to the sides 138, 140, respectively.

The header contacts 106 extend from the rear 136 generally between the mounting legs 144, 146. The header contacts 106 extend into the cavity 142 for mating with the plug connector.

The spring clips 120 are coupled to the mounting legs 144, 146 proximate to distal ends of the mounting legs 144, 146. The spring fingers 124 extend along the outsides of the mounting legs 144, 146. The spring fingers 124 are deflectable toward the outer sides of the mounting legs 144, 146, such as for coupling the spring clips 120 to the circuit board 102.

In an exemplary embodiment, the housing 104 includes standoffs 148 extending from the bottom 132. The standoffs 148 have bottom surfaces 150 that define a mounting plane for the housing 104. The bottom surfaces 150 are coplanar with each other. The bottom surfaces 150 may be held to a tight tolerance to control the positioning of the housing 104 with respect to the circuit board 102. In an exemplary embodiment, the position of the standoffs 148 corresponds to positions of the header contacts 106 and spring clips 120 for surface mounting the header contacts 106 and spring clips 120 to the circuit board 102. For example, the header contacts 106 and spring clips 120 may be held coplanar with the bottom surfaces 150 along the mounting plane of the housing.

Figure 3:
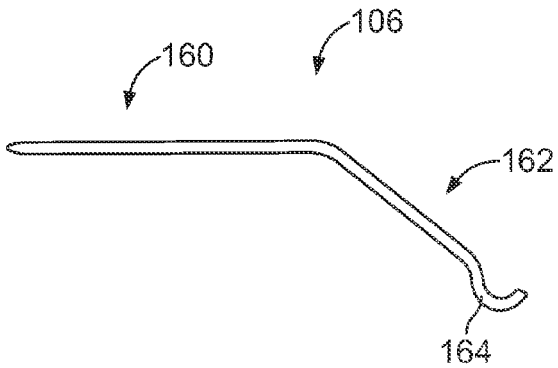
FIG. 3 is a side view of a header contact for the header connector.

FIG. 3 is a side view of one of the header contacts 106 formed in accordance with an exemplary embodiment. The header contact 106 includes a mating portion 160 and a mounting portion 162. The mating portion 160 is configured to be positioned inside the housing 104 (shown in FIG. 1) for electrical connection with the plug connector (not shown). The mounting portion is configured to be mounted to the circuit board 102 (shown in FIG. 1). In an exemplary embodiment, the mounting portion 162 includes a tail 164 at a distal end thereof for surface mounting to the circuit board 102. In an exemplary embodiment, the tail 164 may be soldered to the circuit board 102. The tail 164 may be curved for surface mounting to the circuit board 102.

Figure 4:
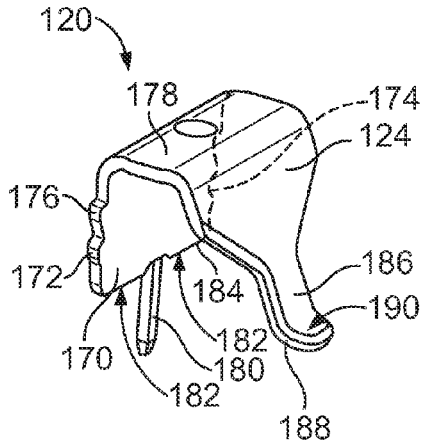
FIG. 4 illustrates a spring clip for the header connector.

FIG. 4 illustrates one of the spring clips 120. The spring clip 120 includes a main body 170 extending between first and second ends 172, 174. The ends 172, 174 include retention barbs 176 to hold the spring clip 120 in the housing 104 (shown in FIG. 2). The spring clip 120 includes a head 178 extending from the main body 170. The spring finger 124 extends from the head 178, generally spaced apart from the main body 170. In an exemplary embodiment, the spring finger 124 is angled with respect to the main body 170 such that the spring finger is non-parallel to the main body 170. The spring finger 124 is deflectable towards the main body 170 and may release back to the non-parallel angle when released. Such spring back is used to drive the spring finger 124 against the circuit board 102 (shown in FIG. 1).

The spring clip 120 includes an alignment pin 180 extending from a bottom of the main body 170. The alignment pin 180 is used to align the spring clip 120 with respect to the circuit board 102 (shown in FIG. 1).

In an exemplary embodiment, the main body 170 defines a surface mounting tab 182 along a shoulder 184 defined along the bottom of the main body 170. The shoulder 184 may abut against the circuit board 102 and may be soldered to the corresponding solder pad 122 (shown in FIG. 1). The alignment pin 180 may also be soldered to the circuit board 102, such as in a plated via of the circuit board 102.

The spring finger 124 includes a tip 186 that is configured to extend into a corresponding opening 126 (shown in FIG. 1) of the circuit board 102 during mounting of the header connector 100 (shown in FIG. 1) to the circuit board 102. The spring finger 124 has a ramp portion 188 at the distal end of the tip 186. The ramp portion 188 is angled with respect to other portions of the tip 186. The ramp portion 188 includes an upward facing surface 190. In the illustrated embodiment, the ramp portion 188 is angled at approximately a 45° angle with respect to the other portion of the tip 186. For example, the ramp portion 188 may be angled at an angle of between approximately 30° and 60° with respect to the tip 186.

Figure 5:
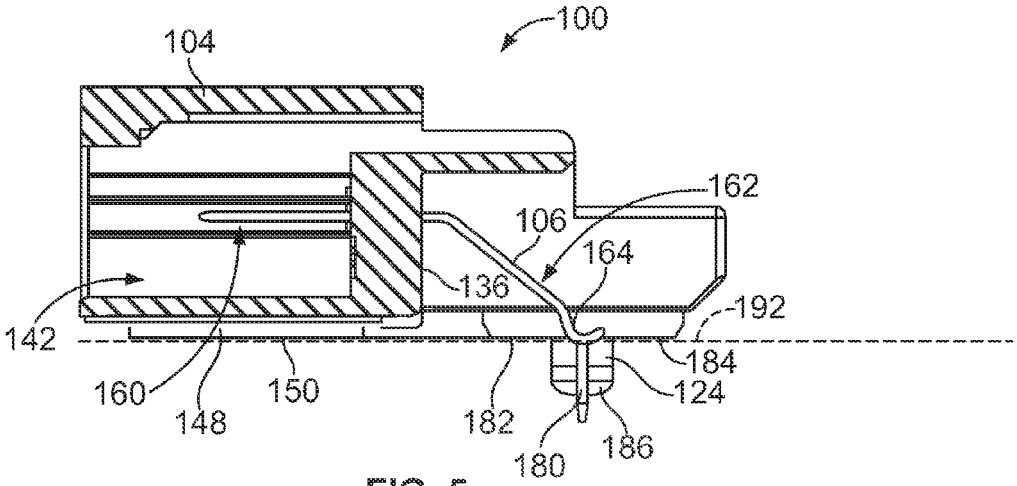
FIG. 5 is a cross sectional view of the header connector.

FIG. 5 is a cross sectional view of the header connector 100. The header contact 106 is loaded into the housing 104 such that the mating portion 160 extends into the cavity 142 for mating engagement with the plug connector (not shown). The mounting portion 162 extends rearward from the rear 136 of the housing 104 toward the bottom of the header connector 100. In an exemplary embodiment, the tail 164 is positioned vertically below a mounting plane 192 of the header connector 100. The mounting plane 192 is defined by the bottom surface 150 of the standoff 148 and the shoulder 184 of the surface mounting tab 182. The shoulder 184 is coplanar with the bottom surface 150 along the mounting plane 192. The tail 164 extends below the mounting plane 192 such that when the header connector 100 is pressed against the circuit board 102 (shown in FIG. 1), the header contact 106 may be slightly deflected, thus preloading the header contact 106 against the circuit board 102. The alignment pin 180 and the spring finger 124 both extend below the mounting plane 192 such that the alignment pin 180 and the spring finger 124 may be loaded into the circuit board 102 when the header connector 100 is mounted thereto. In an exemplary embodiment, the alignment pin 180 extends further below the tip 186 of the spring finger 124 such that the alignment pin 180 may be loaded into the circuit board 102 prior to the spring finger 124. In an alternative embodiment, the alignment pin 180 may be part of a separate clip or other component. The alignment pin 180 may be part of the hosing 104 (shown in FIG. 1).

Figure 6:
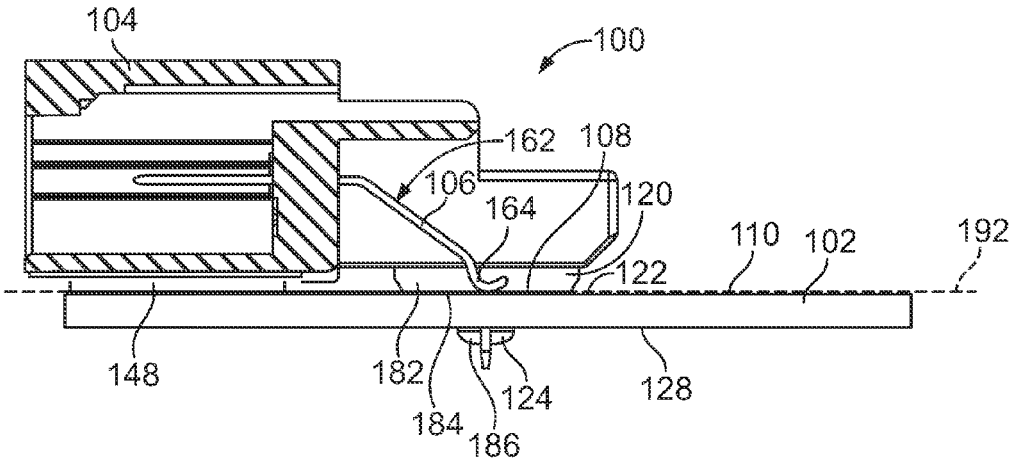
FIG. 6 is a side cross sectional view of the header connector mounted to a circuit board.

FIG. 6 is a side cross sectional view of the header connector 100 mounted to the circuit board 102. The housing 104 rests on the mounting surface 110 of the circuit board 102. For example, the standoffs 148 rest on the mounting surface 110. The surface mounting tabs 182 engage corresponding solder pads 122 on the mounting surface 110 of the circuit board 102. The shoulders 184 engage the solder pads 122. The surface mounting tabs 182 may be soldered to the soldered pads 122 once the header connector 100 is positioned on the circuit board 102. The mounting portions 162 of the header contacts 106 engage the corresponding pads 108 on the mounting surface 110 of the circuit board 102. The tails 164 may be soldered to the pads 108.

The mounting portions 162 are preloaded against the circuit board 102 to ensure that the header contacts 106 engage the corresponding pads 108. Each of the tails 164 of the header contacts 106 are coplanar with the mounting plane 192 because the header contacts 106 are preloaded against the circuit board 102. The circuit board 102 is used to control coplanarity of the header contacts 106 because, prior to being mounted to the circuit board 102, the tails 164 of each of the header contacts 106 is positioned below the mounting plane 192. Once the header connector 100 is held against the circuit board 102, each of the header contacts 106 is at least partially deflected and such deflection biases the header contacts 106 against the circuit board 102 to ensure that each of the tails 164 engages the corresponding pad 108. The spring clips 120 are used to hold the header connector 100 against the circuit board 102. For example, the tips 186 of the spring fingers 124 engage the bottom side 128 of the circuit board 102 to pull the header connector 100 against the mounting surface 110. The tips 186 press against the bottom side 128 of the circuit board 102 to impart a downward force on the housing 104 and the header contacts 106 toward the mounting surface 110.

Figure 7:
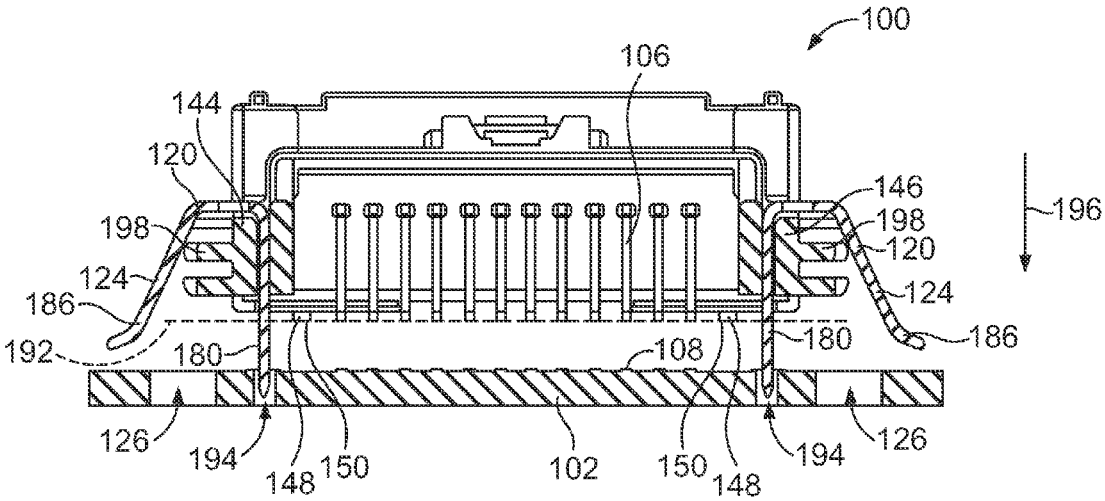
FIG. 7 is a cross sectional view of a portion of the header connector.

FIG. 7 is a cross sectional view of a portion of the header connector 100. FIG. 7 illustrates the alignment pins 180 of the spring clips 120 loaded into alignment vias 194 in the circuit board 102. The alignment pins 180 align the header contacts 106 with the corresponding pads 108 on the circuit board 102. Once the alignment pins 180 are received in the alignment vias 194, movement of the header connector 100 is limited to movement along a mounting direction 196. In an exemplary embodiment, the mounting direction 196 may be a vertical direction, such as when the circuit board 102 is oriented horizontally. As shown in FIG. 7, prior to preloading, the header contacts 106 are positioned below the mounting plane 192 defined along the bottom surfaces 150 of the standoffs 148.

The spring fingers 124 of the spring clips 120 are deflectable toward the sides of the mounting legs 144, 146. During assembly, the spring fingers 124 are pinched inward until the tips 186 are aligned with the openings 126. Tabs 198 along the mounting legs 144, 146 may limit the amount of inward deflection of the spring fingers 124. Optionally, the header connector 100 may be mounted to the circuit board 102 by an automated process using a machine. The machine may pinch the spring fingers 124 inward against the tabs 198 and then align the header connector with the circuit board 102. For example, the alignment pins 180 may be aligned with the alignment vias 194 and the spring fingers 124 may be aligned with the openings 126. The header connector 100 may then be mounted to the circuit board 102 along the mounting direction 196.

Figure 8:
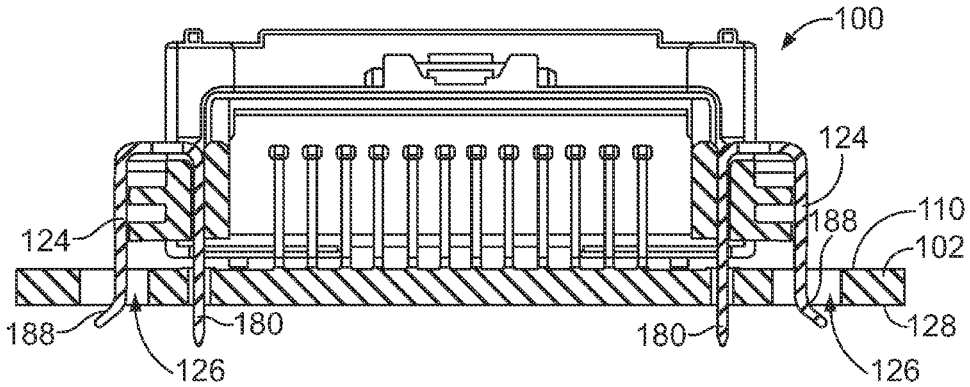
FIG. 8 is a cross sectional view of the header connector being mounted to the circuit board.

FIG. 8 is a cross sectional view of the header connector 100 being mounted to the circuit board 102 showing the spring fingers 124 loaded through the openings 126. The alignment pins 180 guide mounting of the header connector 100 onto the circuit board 102. Once the header connector 100 is positioned on the mounting surface 110 of the circuit board 102 the spring fingers 124 may be released. The ramp portions 188 of the spring fingers 124 may engage the bottom side 128 of the circuit board 102 once the spring fingers 124 are released.

Figure 9:
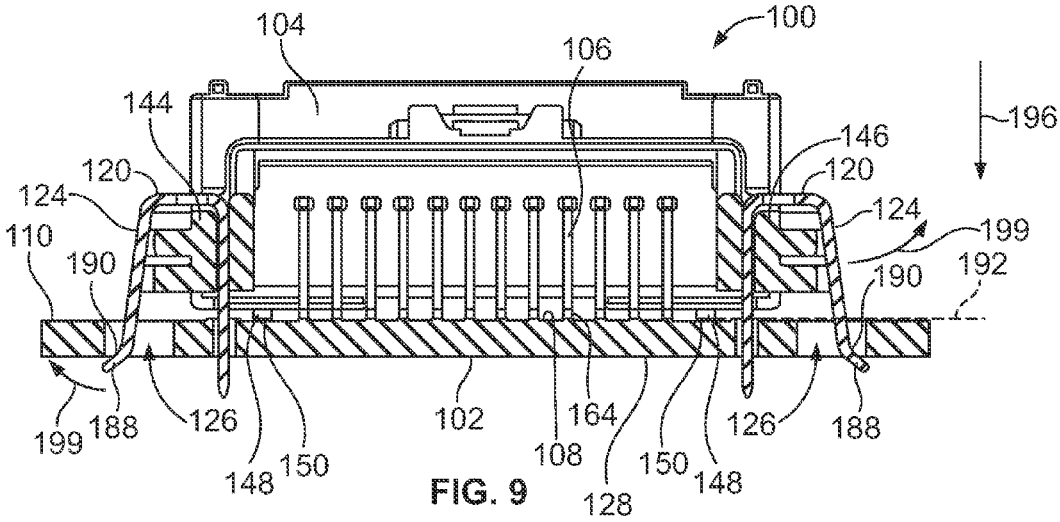
FIG. 9 is a cross sectional view of the header connector mounted to the circuit board.

FIG. 9 is a cross sectional view of the header connector 100 showing the spring fingers 124 released. Spring forces of the spring fingers cause movement of the header connector 100 along the mounting direction 196 towards the mounting surface 110. The ramp portions 188 engage the bottom side 128 of the circuit board 102.

During use, as the spring fingers 124 are released from the deflected position to return to the normal undeflected state, the ramp portions 188 engage the circuit board 102. The upward facing surface 190 of the ramp portion 188 engages the bottom side 128 generally at the intersection between the bottom side 128 and the opening 126. Upon releasing of the spring fingers, the ramp portions 188 are driven against the bottom side 128 of the circuit board 102 at the corresponding openings 126 to drive the spring fingers 124 in a downward direction to pull the housing 104 toward the mounting surface 110 and to pull the header contacts 106 toward the mounting surface 110. When the spring fingers 124 are released, the spring fingers 124 spring away from the housing 104 and the corresponding mounting legs 144, 146 in a releasing direction 199, which is generally parallel to the bottom side 128 and the mounting surface 110. The spring fingers 124 have a spring force in the releasing direction 199, which may be converted to a downward pulling force when the ramp portions 188 engage the bottom side 128 of the circuit board 102.

Releasing of the spring fingers 124 in the releasing direction 199 causes the ramp portions 188 to ride along the bottom side 128, thus forcing the header connector 100 to move in the mounting direction 196. The spring force of the spring clips 120 pull the header connector 100 downward toward the mounting surface 110. The spring clips 120 pull the housing 104, such as the bottom surfaces 150 of the standoffs 148, against the mounting surface 110. The spring clips 120 pull the header contacts 106 against the pads 108. Preloading of the header contacts 106 ensures that the tails 164 of each of the header contacts 106 are coplanar with the mounting plane 192 and ensures that the header contacts 106 engage and are biased against the pads 108 for soldering thereto.

The ramp portions 188 are angled at approximately 45° with respect to the bottom side 128 of the circuit board 102. As the ramp portions 188 engage the bottom side 128 of the circuit board 102, the spring force of the spring fingers 124 in the releasing direction 199 is converted to a pulling force in the mounting direction 196, which is generally perpendicular to the spring force in the releasing direction 199.

Figure 10:
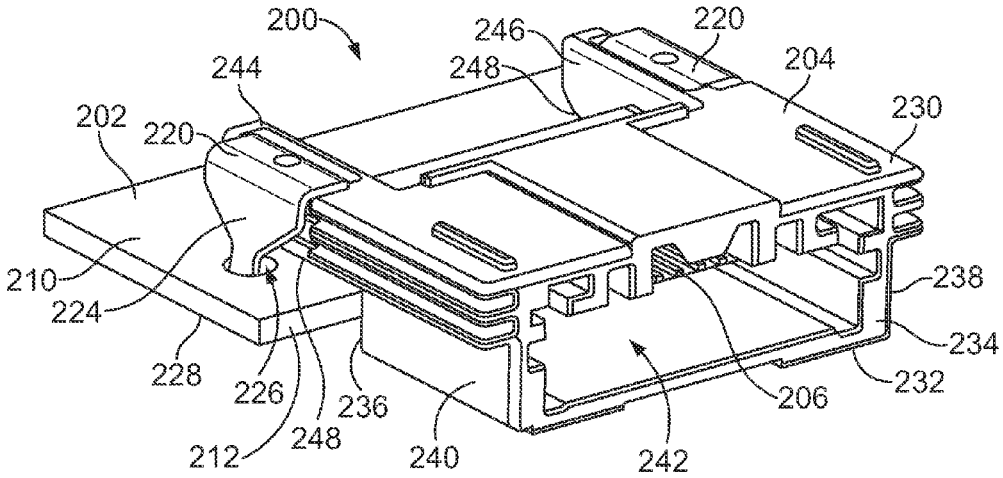
FIG. 10 is a front perspective view of a header connector formed in accordance with an exemplary embodiment.

FIG. 10 is a front perspective view of a header connector 200 formed in accordance with an exemplary embodiment. The header connector 200 is similar to the header connector 100 (shown in FIG. 1), however the header connector 200 is configured to be positioned generally in front of a circuit board 202, rather than on top of the circuit board 102 (shown in FIG. 1) as is the case with the header connector 100.

The header connector 200 includes a housing 204 holding a plurality of header contacts 206 (shown in FIG. 11) configured to be surface mounted to a mounting surface 210 of the circuit board 202. The header connector 200 is generally mounted to the mounting surface 210 of the circuit board 202 such that the housing 204 is forward of a front edge 212 of the circuit board 202.

In an exemplary embodiment, the housing 204 is secured to the circuit board 202 using spring clips 220. The spring clips 220 may be substantially similar to the spring clips 120 (shown in FIG. 1). The spring clips 220 have portions that are surface mounted to the circuit board 202 at corresponding soldered pads (not shown) on the mounting surface 210 of the circuit board 202. In an exemplary embodiment, the spring clips 220 include spring fingers 224 that extend through openings 226 in the circuit board 202. The spring fingers 224 engage a bottom side 228 of the circuit board 202 to secure the header connector 200 to the circuit board 202. The spring fingers 224 pull the housing 204 and header contacts 206 toward the mounting surface 210.

In an exemplary embodiment, the header contacts 206 are held in a coplanar arrangement for soldering to the circuit board 202 by the spring clips 220. For example, the spring clips 220 may pull the housing 204 and header contacts 206 against the mounting surface 210, which preloads the header contacts 206 against the circuit board 202 prior to soldering the header contacts 206 to the circuit board 202.

The housing 204 includes a top 230 and a bottom 232 generally opposite the top 230. The housing 204 includes a front 234 and a rear 236 generally opposite the front 234. The housing 204 includes opposite sides 238, 240 extending between the front 234 and the rear 236. The housing 204 includes a cavity 242 that receives the plug connector (not shown) therein. The cavity 242 is open at the front 234 to receive the plug connector.

The housing 204 includes mounting legs 244, 246 extending rearward from the rear 236. In the illustrated embodiment, the mounting legs 244, 246 are positioned near the top 230. Other positions of the mounting legs 244, 246 are possible alternative embodiments. The mounting legs 244, 246 extend from the housing 204 proximate to the sides 240, 238, respectively.

The mounting legs 244, 246 have bottoms 248 facing the circuit board 202. The mounting legs 244, 246 may be configured to be mounted to the mounting surface 210 of the circuit board 202 such that the rear 236 of the housing 204 is forward of the front edge 212 of the circuit board 202. The top 230 of the housing 204 is positioned higher than the mounting surface 210 of the circuit board 202 and the bottom 232 of the housing 204 is positioned lower than the bottom side 228 of the circuit board 202. The cavity 242 is generally vertically aligned with the circuit board 202 forward of the circuit board 202. Positioning the housing 204 forward of, and aligned with, the circuit board 202 lowers the vertical height of the header connector 100. A low profile connector is provided by such arrangement, as compared to the header connector 100 (shown in FIG. 1).

The spring clips 220 are used to hold the header connector 200 in position for soldering the header connector 200 to the circuit board 202. For example, the spring clips 220 may resist rotation of the header connector 200 off of the circuit board 202 while the spring clips 220 and header contacts 206 are soldered to the circuit board 202.

Figure 11:
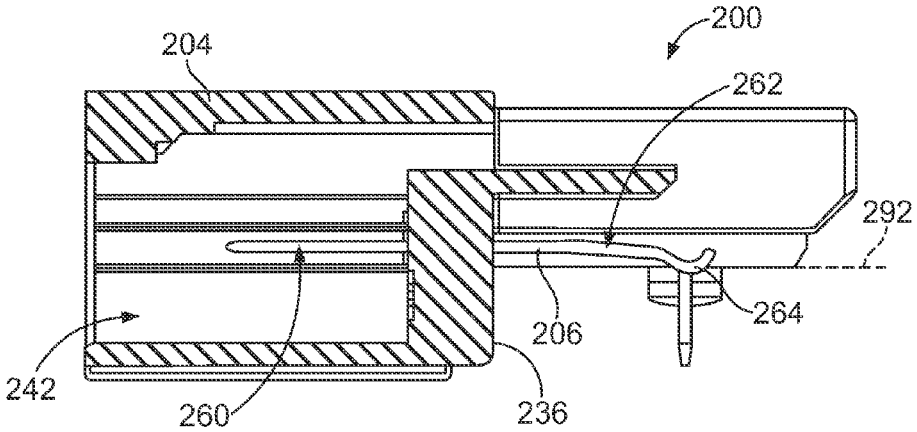
FIG. 11 is a cross sectional view of the header connector.

FIG. 11 is a cross sectional view of the header connector 200. The header contact 206 is loaded into the housing 204 such that a mating portion 260 thereof extends into the cavity 242 for mating engagement with the plug connector (not shown). A mounting portion 262 of the header contact 206 extends rearward from the rear 236 of the housing 204. Optionally, the mounting portion 262 may be angled slightly downward such that a tail 264 thereof is positioned vertically below a mounting plane 292 of the header connector 200. The tail 264 extends below the mounting plane 292 such that when the header connector 200 is pressed against the circuit board 202 (shown in FIG. 10), the header contact 206 may be slightly deflected, thus preloading the header contact 206 against the circuit board 202.

Figure 12:
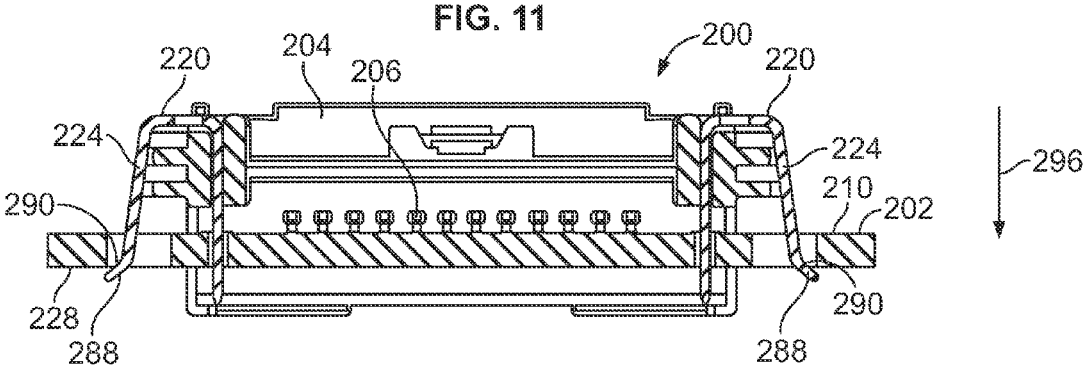
FIG. 12 is a cross sectional view of a portion of the header connector.

FIG. 12 is a cross sectional view of a portion of the header connector 200. The spring fingers 224 of the spring clips 220 are illustrated biased against the bottom side 228 of the circuit board 202. Spring forces of the spring fingers 224 cause movement of the header connector 200 along a mounting direction 296 towards the mounting surface 210. Ramp portions 288 of the spring fingers 224 engage the bottom side 228 of the circuit board 202. Upward facing surfaces 290 of the ramp portions 288 engage the bottom side 228 of the circuit board 202 to drive the spring fingers 224 in a downward direction to pull the housing 204 toward the mounting surface 210 and to pull the header contacts 206 toward the mounting surface 210.

Figure 13:
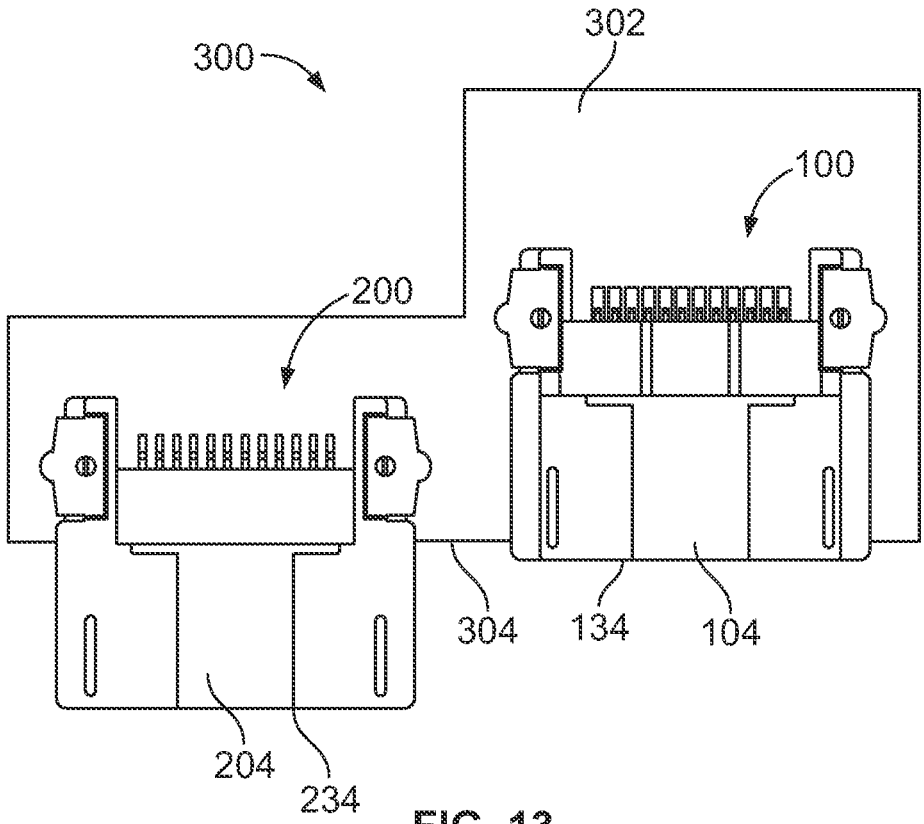
FIG. 13 is a top view of a system showing a header connector mounted to a circuit board adjacent to the header connector.

FIG. 13 is a top view of a system 300 showing the header connector 100 mounted to a circuit board 302 adjacent to the header connector 200. The housing 104 slightly overhangs a front edge 304 of the circuit board 302, while the entire housing 204 is positioned forward of the front edge 304. The front edge 304 is recessed further from the front 234, as compared to from the front 134. Optionally, a smaller circuit board may be used with the header connector 200 as compared to the header connector 100 as the circuit board does not need to extend as far forward.

Figure 14:
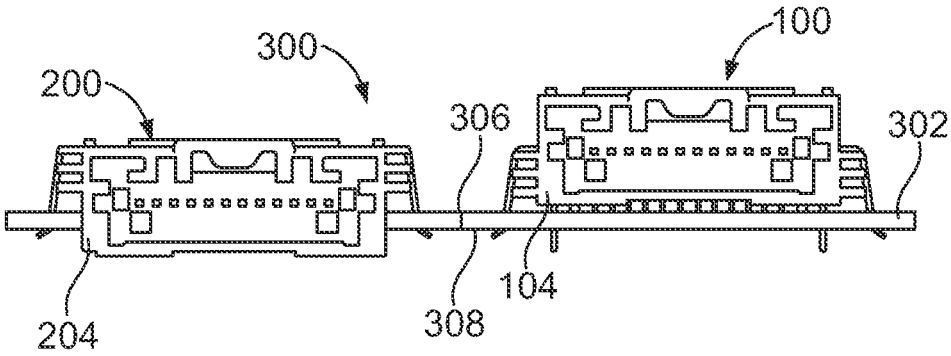
FIG. 14 is a front view of the system showing header connectors mounted to a circuit board.

FIG. 14 is a front view of the system 300 showing the header connectors 100, 200 mounted to a circuit board 302. The housing 104 is entirely positioned above a mounting surface 306 of the circuit board 302, while a portion of the housing 204 is positioned below the mounting surface 306 and below a bottom side 308 of the circuit board 302. The header connector 200 has a lower profile from the mounting surface 306 (e.g. height above the mounting surface 306) as compared to the header connector 100.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A header connector comprising:

a housing configured to be mounted to a circuit board;

header contacts held by the housing, the header contacts having mating portions and mounting portions, the mounting portions being configured to be surface mounted to corresponding pads on the circuit board; and a spring clip coupled to the housing, the spring clip having a spring finger extending through the circuit board to engage a bottom side of the circuit board opposite the mounting surface of the circuit board, the spring clip pulling the housing and header contacts toward the mounting surface, the spring clip including a surface mounting tab, the surface mounting tab defining a mounting plane and being configured to engage the mounting surface of the circuit board;

wherein the mounting portions of the header contacts are positioned below the mounting plane prior to mounting to the circuit board, and wherein the mounting portions of the header contacts are preloaded against the circuit board when the surface mounting tab is mounted to the circuit board, the mounting portions of the header contacts being coplanar with the surface mounting tab along the mounting plane when the surface mounting tab is mounted to the circuit board.

2. The header connector of claim 1, wherein the spring finger imparts a downward force on the housing to pull the housing and header contacts towards the mounting surface.

3. The header connector of claim 1, wherein the spring finger includes a ramp portion, the ramp portion being upward facing, the ramp portion being configured to engage the bottom side of the circuit board to pull the housing downward.

4. The header connector of claim 1, wherein the spring finger includes a ramp portion, the ramp portion being upward facing, the spring finger being deflected toward the housing to align with an opening in the circuit board to load the spring finger through the circuit board, upon releasing the spring finger the ramp portion is driven against the bottom side of the circuit board at the opening to drive the spring finger in a downward direction to pull the housing towards the mounting surface.

5. The header connector of claim 1, wherein the spring finger is deflectable towards the housing and springs away from the housing when released in a releasing direction generally parallel to the mounting surface, the spring finger including an angled ramp portion angled with respect to the bottom side of the circuit board, the ramp portion engaging the bottom side of the circuit board to convert spring force of the spring finger along the releasing direction to a pulling force in a direction generally perpendicular to the spring force.

6. The header connector of claim 1, further comprising an alignment pin extending below the housing, the alignment pin being configured to be received in the circuit board to align the housing and header contacts with the circuit board, the alignment pin restricting movement of the header connector in a mounting direction generally perpendicular to the mounting surface of the circuit board, wherein spring forces of the spring finger cause movement of the header connector along the mounting direction toward the mounting surface.

7. The header connector of claim 1, further comprising a second spring clip coupled to the housing, the second spring clip having a second spring finger, the second spring clip having a surface mounting tab, the surface mounting tabs being coplanar along the mounting plane and being configured to engage the circuit board.

8. The header connector of claim 1, wherein the housing includes a front and a rear, a top and a bottom, the housing having a cavity open at the front for receiving a mating connector, the housing having mounting legs extending from the rear, the mounting legs having bottoms facing the circuit board, the mounting legs being configured to be mounted to the mounting surface of the circuit board such that the rear of the housing is forward of the front edge of the circuit board, the top of the housing is positioned higher than the mounting surface of the circuit board and the bottom of the housing is positioned lower than a bottom side of the circuit board, the cavity being generally vertically aligned with the circuit board forward of the circuit board.

9. A header connector comprising:

a housing having mounting legs configured to be mounted to a mounting surface of the circuit board, the mounting legs having a bottom facing the circuit board;

surface mounting tabs extending from the bottom of the mounting legs, the surface mounting tabs being coplanar along a mounting plane and being configured to engage and be soldered to the mounting surface of the circuit board;

header contacts held by the housing, the header contacts having mating portions and mounting portions, the mounting portions being positioned below the mounting plane prior to mounting to the circuit board, the mounting portions being preloaded against the circuit board when the surface mounting tabs are mounted to the circuit board, the mounting portions being coplanar with the surface mounting tabs along the mounting plane when the surface mounting tabs are mounted to the circuit board and being configured to be soldered to corresponding pads on the circuit board; and spring clips coupled to the mounting legs, the spring clips each having a spring finger extending through the circuit board to engage a bottom side of the circuit board opposite the mounting surface of the circuit board, the spring clip pulling the mounting legs and header contacts toward the mounting surface until the surface mounting tabs engage the mounting surface of the circuit board.

10. The header connector of claim 9, wherein the spring fingers impart a downward force on the housing to pull the housing and header contacts towards the mounting surface.

11. The header connector of claim 9, wherein the spring fingers each includes a ramp portion, the ramp portion being upward facing, the ramp portion being configured to engage the bottom side of the circuit board to pull the housing downward.

12. The header connector of claim 9, wherein the spring fingers each include a ramp portion, the ramp portion being upward facing, the spring fingers being deflected toward the housing to align with corresponding openings in the circuit board to load the spring fingers through the circuit board, upon releasing the spring fingers the ramp portion is driven against the bottom side of the circuit board at the opening to drive the spring fingers in a downward direction to pull the housing towards the mounting surface.

13. The header connector of claim 9, wherein the spring fingers are deflectable towards the housing and spring away from the housing when released in a releasing direction generally parallel to the mounting surface, the spring fingers each including a ramp portion angled with respect to the bottom side of the circuit board, the ramp portion engaging the bottom side of the circuit board to convert spring forces of the spring fingers along the releasing directions to a pulling force in a direction generally perpendicular to the spring forces.

14. The header connector of claim 9, further comprising an alignment pin extending from each surface mounting tab, the alignment pins being configured to be received in the circuit board to align the housing and header contacts with the circuit board, the alignment pins restricting movement of the header connector in a mounting direction generally perpendicular to the mounting surface of the circuit board, wherein spring forces of the spring finger cause movement of the header connector along the mounting direction toward the mounting surface.

15. The header connector of claim 9, wherein the housing includes a front and a rear, a top and a bottom, the housing having a cavity open at the front for receiving a mating connector, the mounting legs extending from the rear, the mounting legs being configured to be mounted to the mounting surface of the circuit board such that the rear of the housing is forward of the front edge of the circuit board, the top of the housing is positioned higher than the mounting surface of the circuit board and the bottom of the housing is positioned lower than a bottom side of the circuit board, the cavity being generally vertically aligned with the circuit board forward of the circuit board.

16. A header connector comprising:

a housing configured to be mounted to a circuit board;

header contacts held by the housing, the header contacts having mating portions and mounting portions, the mounting portions being configured to be surface mounted to corresponding pads on the circuit board; and a spring clip coupled to the housing, the spring clip having an alignment pin at a first end of the spring clip, the alignment pin extending through an alignment opening in the circuit board to align the spring clip with the circuit board, the spring clip having a spring finger at a second end of the spring clip, the spring finger extending through the circuit board to engage a bottom side of the circuit board opposite the mounting surface of the circuit board, the spring clip pulling the housing and header contacts toward the mounting surface, wherein the alignment pin extends below the spring finger such that the alignment pin is received in the alignment opening to locate the spring clip relative to the circuit board prior to the spring finger passing through the circuit board.

17. The header connector of claim 16, wherein the spring finger includes a ramp portion, the ramp portion being upward facing, the ramp portion being configured to engage the bottom side of the circuit board to pull the housing downward.

18. The header connector of claim 16, wherein the spring finger includes a ramp portion, the ramp portion being upward facing, the spring finger being deflected toward the housing to align with an opening in the circuit board to load the spring finger through the circuit board, upon releasing the spring finger the ramp portion is driven against the bottom side of the circuit board at the opening to drive the spring finger in a downward direction to pull the housing towards the mounting surface.

19. The header connector of claim 16, wherein the spring finger is deflectable towards the housing and springs away from the housing when released in a releasing direction generally parallel to the mounting surface, the spring finger including an angled ramp portion angled with respect to the bottom side of the circuit board, the ramp portion engaging the bottom side of the circuit board to convert spring force of the spring finger along the releasing direction to a pulling force in a direction generally perpendicular to the spring force.

20. The header connector of claim 16, further comprising surface mounting tabs extending from a bottom of the housing, the surface mounting tabs being coplanar along a mounting plane and being configured to engage and be soldered to the circuit board, wherein the mounting portions of the header contacts are positioned below the mounting plane prior to mounting to the circuit board, and wherein the mounting portions of the header contacts are preloaded against the circuit board when the surface mounting tabs are mounted to the circuit board, the mounting portions of the header contacts being coplanar with the surface mounting tabs along the mounting plane when the surface mounting tabs are mounted to the circuit board.

* * * * *